US009193060B2

(12) United States Patent
Ben-Gigi

(10) Patent No.: US 9,193,060 B2
(45) Date of Patent: Nov. 24, 2015

(54) TOOL BOX ASSEMBLY

(71) Applicant: Zion Ben-Gigi, Kfar Veradim (IL)

(72) Inventor: Zion Ben-Gigi, Kfar Veradim (IL)

(73) Assignee: TEFENPLAST LTD., Tefen (IL)

( * ) Notice: Subject to any disclaimer, the term of this patent is extended or adjusted under 35 U.S.C. 154(b) by 75 days.

(21) Appl. No.: 14/096,066

(22) Filed: Dec. 4, 2013

(65) Prior Publication Data

US 2015/0151427 A1 Jun. 4, 2015

(51) Int. Cl.

| | |
|---|---|
| ***B65D 21/032*** | (2006.01) |
| ***B25H 3/02*** | (2006.01) |
| ***B65D 21/02*** | (2006.01) |
| ***B65D 25/28*** | (2006.01) |

(52) U.S. Cl.

CPC ..... *B25H 3/021* (2013.01); *B25H 3/026* (2013.01); *B65D 21/0228* (2013.01); *B65D 25/2867* (2013.01)

(58) Field of Classification Search

CPC ..... B25H 3/021; B25H 3/022; B25H 3/026; B65D 21/0228; B65D 21/0212; B65D 21/0209; B65D 21/023; B65D 21/00; B65D 25/28; B65D 25/2835; B65D 25/2844; B65D 25/2838; B65D 25/285; B65D 25/2852; B65D 25/32; B65D 25/2855; B65D 25/2867

USPC ..... 206/501, 508; 220/756, 773, 762, 769

See application file for complete search history.

(56) References Cited

U.S. PATENT DOCUMENTS

| | | | | |
|---|---|---|---|---|
| 5,169,018 | A * | 12/1992 | Fiore | 220/318 |
| 5,226,553 | A | 7/1993 | Fiore | |
| 2002/0000440 | A1 | 1/2002 | Sagol | |
| 2003/0094392 | A1 * | 5/2003 | Meier et al. | 206/503 |
| 2004/0188294 | A1 | 9/2004 | Chen | |
| 2012/0080432 | A1 | 4/2012 | Bensman et al. | |

OTHER PUBLICATIONS

PCT Written Opinion, PCT/US2014/068492, received Apr. 21, 2015.

* cited by examiner

*Primary Examiner* — Stephen Castellano

(74) *Attorney, Agent, or Firm* — Dekel Patent Ltd.; David Klein

(57) ABSTRACT

A tool box organizer is arranged to removably sit on top of a bottom tool box. The tool box organizer has a handle with a catch. The handle pivots so the catch locks on the bottom tool box.

7 Claims, 4 Drawing Sheets

TOOL BOX ASSEMBLY

FIELD OF THE INVENTION

The present invention relates generally to tool and tool accessory boxes or cases and particularly to a tool box assembly with a tool box organizer that locks on top of a bottom tool box.

BACKGROUND OF THE INVENTION

Tool and tool accessory boxes (or cases, the terms being used interchangeably) are used to hold and organize all sorts of tools. such as screwdrivers, wrenches, hammers, etc., and small parts such as drill bits, fasteners, and nails. It is desirable to keep the accessories organized so that the user can easily locate the specific tool accessory for the particular purpose.

Tool accessories are commonly organized in individual compartments that are stored within the tool accessory case, and the case is secured with a latch to prevent the tool accessories from escaping the compartment. While a tool accessory case has the advantage of confining the tool accessory to the inner organizational compartment, the latch on the case may be difficult to open and close, particularly if the user is wearing work gloves or only has one hand available. Further, some latches are prone to open upon impact, such as when the case is dropped, allowing the tool accessories to escape the tool accessory case.

SUMMARY OF THE INVENTION

The present invention seeks to provide a novel tool box assembly with a tool box organizer that sits on top of a bottom tool box, as is described more in detail hereinbelow. The handle of the organizer locks on to the bottom tool box and the bottom tool box has a handle that can either pivot or be locked from pivoting (for carrying).

There is thus provided in accordance with a non-limiting embodiment of the present invention a tool box assembly including a first tool box including side walls extending from a bottom member and a tool box handle pivotally connected to a portion of the first tool box, the side walls and the bottom member defining a first tool holding chamber, and a second tool box including side walls extending from a bottom member and an organizer handle pivotally connected to a portion of the second tool box, the side walls and the bottom member defining a second tool holding chamber, the second tool box arranged to removably sit on top of the first tool box, wherein the first tool box includes a rim and the organizer handle includes a catch, wherein upon sufficient pivoting of the organizer handle towards the first tool box, the catch latches on to the rim of the first tool box so as to lock the second tool box with the first tool box.

In accordance with an embodiment of the present invention, the organizer handle includes arms whose first ends are pivotally connected to at least one of the side walls of the second tool box and a grip member joined to second ends of the arms distanced from the first ends, and the catch protrudes from the grip member.

In accordance with an embodiment of the present invention, the rim faces towards the bottom member of the second tool box and there is a gap between the rim and at least one of the side walls of the first tool box, and the grip member includes an overhanging roof portion and the catch protrudes from the overhanging roof portion, wherein upon sufficient pivoting of the organizer handle towards the first tool box, the catch initially abuts against one side of the rim and then lockingly snaps over the rim to be positioned in the gap.

In accordance with an embodiment of the present invention, the tool box handle extends outwards of the second tool box.

In accordance with an embodiment of the present invention, the tool box handle pivots over the second tool box.

In accordance with an embodiment of the present invention, the organizer handle is recessed in a recess formed in the second tool box.

In accordance with an embodiment of the present invention, when the second tool box sits on top of the first tool box, the side walls of the tool boxes are flush with each other.

In accordance with an embodiment of the present invention, the first and the second tool boxes include mating male and female connections.

In accordance with an embodiment of the present invention, a pivoted connection of the tool box handle to the first tool box includes a vertically oval lug protruding from the at least one of the side walls, the oval lug being formed with downwardly facing shoulders. The oval lug is received in a complimentary-shaped oval channel formed in a side arm of the tool box handle. The channel includes inwardly protruding, upwardly facing shoulders that abut against the downwardly facing shoulders when the tool box handle is lifted upwards for carrying the first tool box, thereby preventing rotation of the tool box handle with respect to the first tool box. When the tool box handle is not lifted upwards, the upwardly facing shoulders do not abut against the downwardly facing shoulders and the tool box handle can pivot with respect to the first tool box.

BRIEF DESCRIPTION OF THE DRAWINGS

The present invention will be understood and appreciated more fully from the following drawings.

DETAILED DESCRIPTION OF EMBODIMENTS

Figure 1:
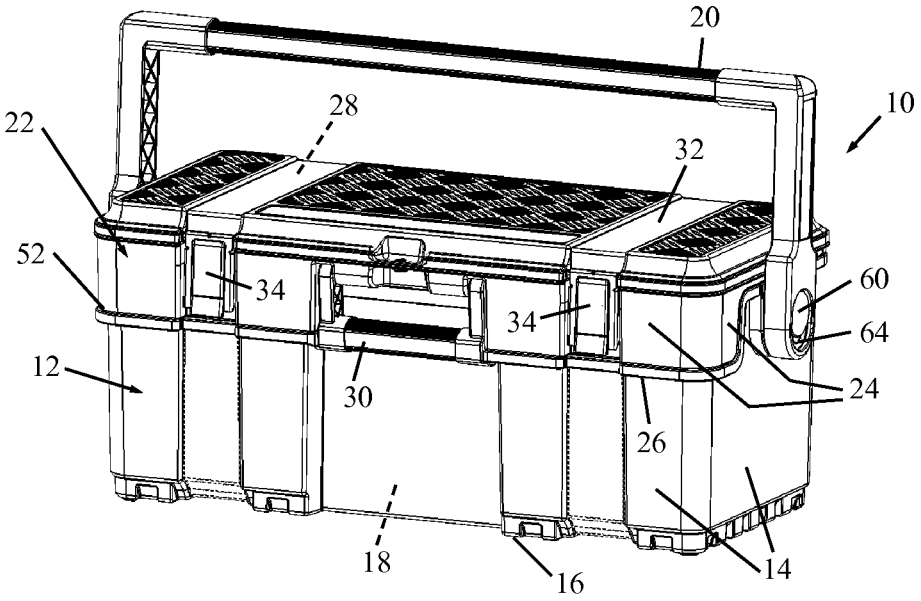
FIG. 1 is a simplified pictorial illustration of a tool box assembly, constructed and operative in accordance with a non-limiting embodiment of the present invention, including a tool box organizer arranged to removably sit on top of a bottom tool box.

Reference is now made to FIG. 1, which illustrates a tool box assembly 10, constructed and operative in accordance with a non-limiting embodiment of the present invention.

The tool box assembly 10 includes a first tool box 12 (also called bottom tool box 12) including side walls 14 extending from a bottom member 16. The side walls 14 and the bottom member 16 define a first tool holding chamber 18 (typically, but not necessarily, used for holding bigger tools like screwdrivers, hammers, saws, wrenches and the like). A tool box handle 20 is pivotally connected to a portion of tool box 12, such as one or more of the side walls 14 (such as oppositely-facing side walls).

Figure 2:
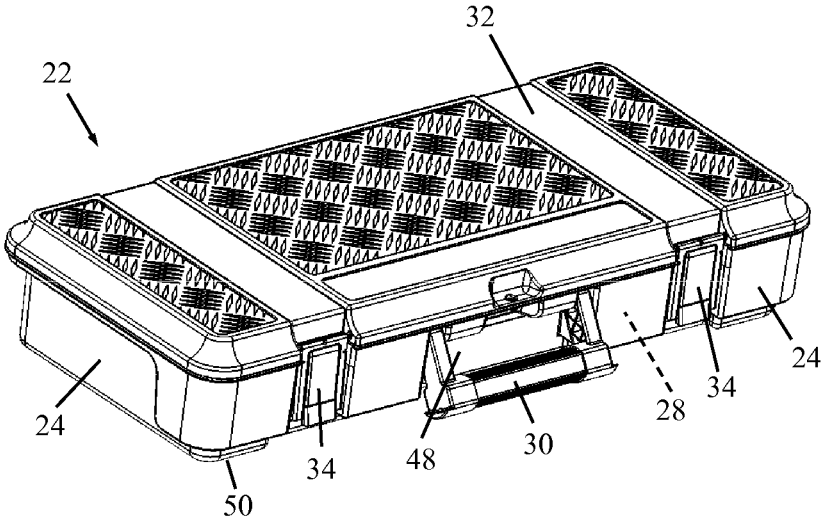
FIG. 2 is a simplified pictorial illustration of the tool box organizer (removed from bottom tool box)

The tool box assembly 10 also includes a second tool box 22 (also called tool box organizer 22), also seen in FIG. 2. The tool box organizer 22 includes side walls 24 extending from a bottom member 26 and an organizer handle 30 pivotally connected to a portion of tool box 22, such as at least one of the side walls 24. The side walls 24 and bottom member 26 define a second tool holding chamber 28 (typically, but not necessarily, used for holding smaller items like screws, nails, molly bolts, drill bits, center punches, and the like). The tool box organizer 22 includes a hinged cover 32 with latches 34. The second tool box 22 is arranged to removably sit on top of the first tool box 12.

Figure 3:
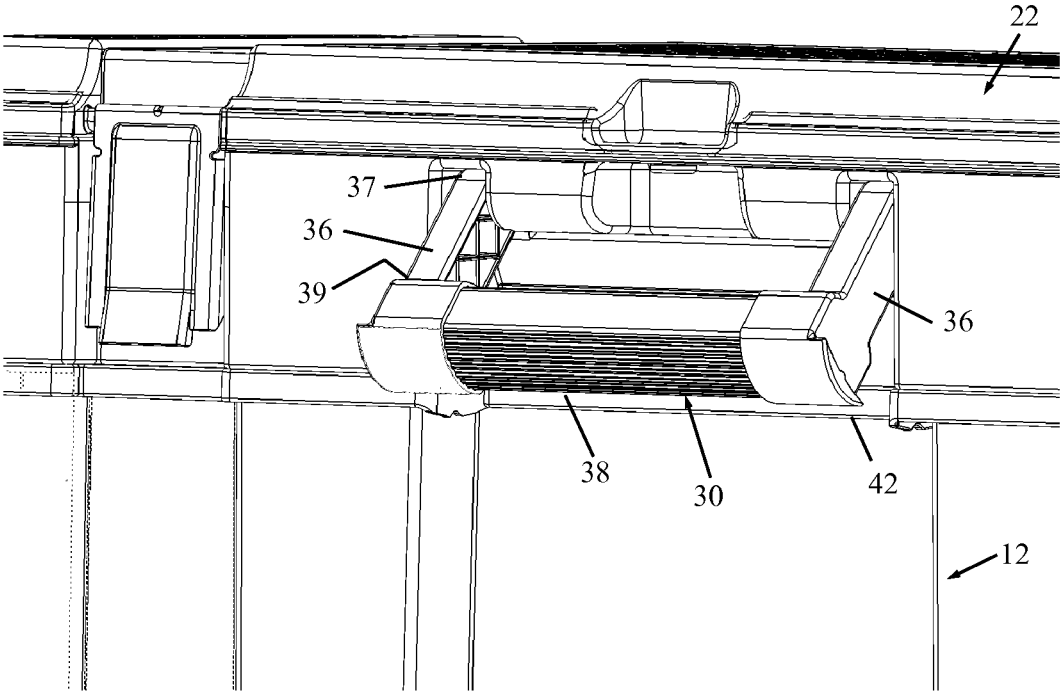
FIG. 3 is a simplified pictorial illustration of the organizer handle being pivoted downward prior to locking on a rim of the bottom tool box, in accordance with an embodiment of the present invention.
Figure 4:
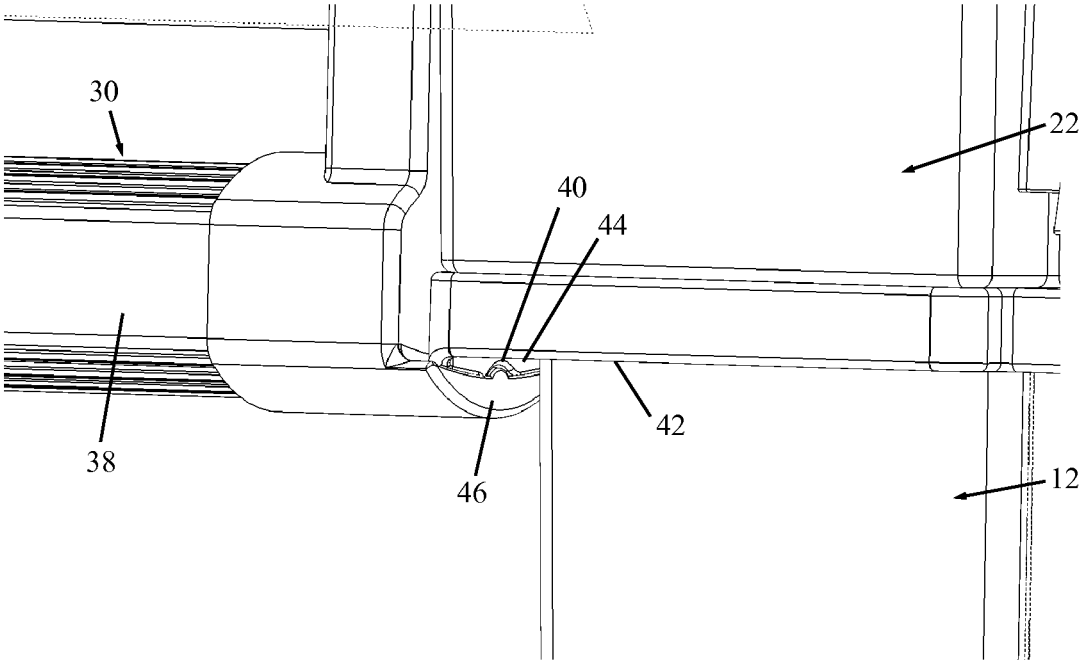
FIG. 4 is a simplified pictorial illustration of the organizer handle locked on the rim of the bottom tool box.

Reference is now made to FIGS. 3 and 4, which illustrate a non-limiting embodiment of carrying out the invention. The organizer handle 30 includes arms 36 whose first ends 37 are pivotally connected to at least one of the side walls 24 of the second tool box 22 and a grip member 38 joined to second ends 39 of the arms 36 distanced from the first ends 37. As seen in FIG. 4, a catch 40 protrudes from the grip member 38. First tool box 12 includes a rim 42 that faces towards the bottom of second tool box 22. There is a gap 44 between the rim 42 and the side wall 14 of the first tool box 12. The grip member 38 includes an overhanging roof portion 46 and the catch 40 protrudes from the underside of the overhanging roof portion 46. Upon sufficient pivoting of the organizer handle 30 towards the first tool box 12, catch 40 initially abuts against one side of rim 42 and then lockingly snaps over rim 42 to be positioned in the gap 44. Thus, catch 40 latches on to rim 42 so as to lock the second tool box 22 with the first tool box 12. The second tool box 22 thus sits in the first tool box 12.

In the non-limiting illustrated embodiment, as seen in FIG. 1, the tool box handle 20 extends outwards of second tool box 22. Tool box handle 20 pivots over second tool box 22. When the second tool box 22 sits on top of the first tool box 12, the side walls of the tool boxes are flush with each other. The organizer handle 30 is recessed in a recess 48 (FIG. 2) formed in second tool box 22.

In accordance with an embodiment of the present invention, the first and the second tool boxes 12 and 22 include mating male and female connections, such as a lug 50 (FIG. 2) protruding from the bottom of second tool box 22 which is received in a recess 52 (FIG. 1) formed on a top portion of first tool box 12.

Figure 5A:
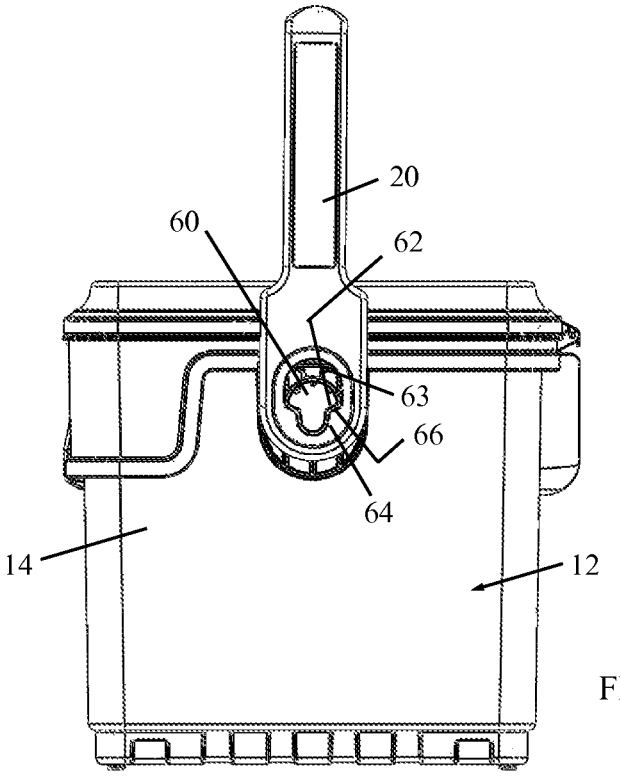
FIGS. 5A and 5B are simplified pictorial illustrations of the handle of the bottom tool box, in accordance with an embodiment of the present invention, respectively with the handle in an upright, locked position and a tilted, unlocked position.
Figure 5B:
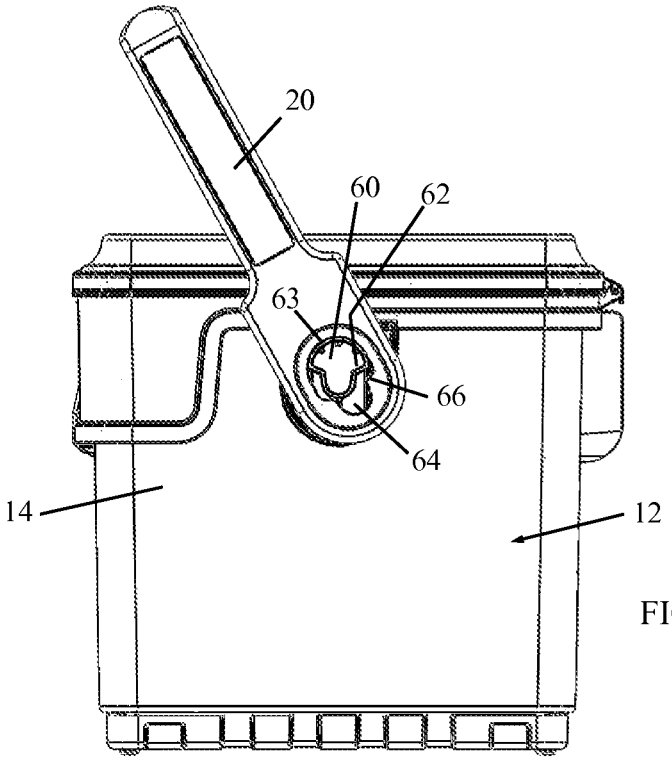

Reference is now made to FIGS. 5A and 5B. In accordance with an embodiment of the present invention, a pivoted connection of the tool box handle 20 to the first tool box 12 includes a vertically oval lug 60 (also seen in FIG. 1) protruding from the side wall 14. The oval lug 60 is formed with downwardly facing shoulders 62. The oval lug 60 is received in a complimentary-shaped oval channel 64 (also seen in FIG. 1) formed in a side arm of the tool box handle 20 which extends from an upper, generally circular portion 63. The channel 64 includes inwardly protruding, upwardly facing shoulders 66 that abut against the downwardly facing shoulders 62 when the tool box handle 20 is lifted upwards for carrying the first tool box 12, thereby preventing rotation of the tool box handle 20 with respect to the first tool box 12 (this is the position shown in FIG. 5A). When the tool box handle 20 is not lifted upwards, the upwardly facing shoulders 66 do not abut against the downwardly facing shoulders 62 and the tool box handle 20 can pivot with respect to the first tool box 12 (this is the position shown in FIG. 5B).

What is claimed is:

1. A tool box assembly comprising:

a first tool box comprising side walls extending from a bottom member and a tool box handle pivotally connected to a portion of said first tool box, said side walls and said bottom member defining a first tool holding chamber; and a second tool box comprising side walls extending from a bottom member and an organizer handle pivotally connected to a portion of said second tool box, said side walls and said bottom member defining a second tool holding chamber, said second tool box arranged to removably sit on top of said first tool box;

wherein said first tool box comprises a rim and said organizer handle comprises a catch, wherein upon sufficient pivoting of said organizer handle towards said first tool box, said catch latches on to said rim of said first tool box so as to lock said second tool box with said first tool box, wherein said organizer handle comprises arms whose first ends are pivotally connected to at least one of the side walls of said second tool box and a grip member joined to second ends of said arms distanced from said first ends, and said catch protrudes from said grip member, and wherein said rim faces towards said bottom member of said second tool box and there is a gap between said rim and at least one of the side walls of said first tool box, and said grip member comprises an overhanging roof portion and said catch protrudes from said overhanging roof portion, wherein upon sufficient pivoting of said organizer handle towards said first tool box, said catch initially abuts against one side of said rim and then lockingly snaps over said rim to be positioned in said gap.

2. The tool box assembly according to claim 1, wherein said tool box handle extends outwards of said second tool box.

3. The tool box assembly according to claim 1, wherein said tool box handle pivots over said second tool box.

4. The tool box assembly according to claim 1, wherein said organizer handle is recessed in a recess formed in said second tool box.

5. The tool box assembly according to claim 1, wherein when said second tool box sits on top of said first tool box, the side walls of said tool boxes are flush with each other.

6. The tool box assembly according to claim 1, wherein said first and said second tool boxes comprise mating male and female connections.

7. A tool box assembly comprising:

a first tool box comprising side walls extending from a bottom member and a tool box handle pivotally connected to a portion of said first tool box, said side walls and said bottom member defining a first tool holding chamber; and a second tool box comprising side walls extending from a bottom member and an organizer handle pivotally connected to a portion of said second tool box, said side walls and said bottom member defining a second tool holding chamber, said second tool box arranged to removably sit on top of said first tool box;

wherein said first tool box comprises a rim and said organizer handle comprises a catch, wherein upon sufficient pivoting of said organizer handle towards said first tool box, said catch latches on to said rim of said first tool box so as to lock said second tool box with said first tool box, and wherein a pivoted connection of said tool box handle to said first tool box comprises a vertically oval lug protruding from said at least one of the side walls, said oval lug being formed with downwardly facing shoulders, and said oval lug being received in a complementary-shaped oval channel formed in a side arm of said tool handle, said channel comprising inwardly protruding, upwardly facing shoulders that abut against said downwardly facing shoulders when said tool box handle is lifted upwards for carrying said first tool box, thereby preventing rotation of said tool box handle with respect to said first tool box and when said tool box handle is not lifted upwards, said upwardly facing shoulders do not abut against said downwardly facing shoulders and said tool box handle can pivot with respect to said first tool box.

* * * * *